United States Patent [19]

Shaw

[11] 4,069,349

[45] Jan. 17, 1978

[54] PROCESS FOR VACUUM PACKAGING OF ROASTED, GROUND COFFEE

[75] Inventor: Fred B. Shaw, Hinsdale, Ill.

[73] Assignee: The Continental Group, Inc., New York, N.Y.

[21] Appl. No.: 375,648

[22] Filed: July 2, 1973

Related U.S. Application Data

[63] Continuation of Ser. No. 48,953, June 22, 1970, abandoned, which is a continuation of Ser. No. 555,123, June 3, 1966, abandoned.

[51] Int. Cl.[2] ..... B65B 9/00; B31B 31/02

[52] U.S. Cl. ..... 426/395; 426/410; 426/419; 426/595

[58] Field of Search ..... 426/118, 131, 395, 410, 426/419, 595

[56] References Cited

U.S. PATENT DOCUMENTS

| | | | |
|---|---|---|---|
| 2,569,217 | 9/1951 | Bagdigian | 426/392 |
| 3,077,409 | 2/1963 | Baselt | 426/392 |

FOREIGN PATENT DOCUMENTS

| | | | |
|---|---|---|---|
| 575,517 | 5/1959 | Canada | 426/392 |

*Primary Examiner*—Thomas G. Wyse
*Assistant Examiner*—Ernest G. Therkorn
*Attorney, Agent, or Firm*—Diller, Brown, Ramik & Wight

[57] ABSTRACT

A process of packaging a solid gas evolving product by filling a plurality of pouches with the product, partially sealing each pouch mouth by a heat seal to leave a relatively small tortuous passage for the escape of gas from the product, transferring the pouches to a storage chamber containing oxygen at atmospheric conditions of temperature and pressure, storing the filled pouches in the chamber until substantially all of the gas capable of evolving from the product has evacuated the pouches, removing the pouches from the storage chamber and thereafter hermetically sealing the pouches against oxygen containing atmosphere by completely sealing each tortuous passage.

5 Claims, 6 Drawing Figures

FROM FIG. 1
10
13
18
20
32
34
35
36
37
38
40
41
44
45
46
47
48
50
51
52
53
54
55
56
57

PROCESS FOR VACUUM PACKAGING OF ROASTED, GROUND COFFEE

This is a continuation of application Ser. No. 48,953, filed June 22, 1970 which in turn is a continuation of Ser. No. 555,123, filed June 3, 1966, both now abandoned.

This application relates in general to new and useful improvements in the packaging art, and is directed more particularly to the vacuum packaging of gas-evolving products, such as ground coffee.

Heretofore it has been known in the packaging art to package gas-evolving products, particularly freshly roasted ground coffee. In rigid metallic containers. During the conventional packaging of coffee, it is common to first grind freshly roasted coffee beans and allow the ground coffee to de-gas for a time period up to 48 hours or more while in hoppers or other exposed balk containers. The de-gassing generally takes place in an atmosphere which causes undesired oxidation of the coffee and an attended loss in the flavor and quality thereof.

This de-gassing in "bulk" has also been found to be highly disadvantageous from a production standpoint in at least one particular instance in which a coffee filling line was shut-down because the previous work shift had forgotten to grind coffee for the subsequent work shift and it was necessary for the latter shift to await de-gassing of the coffee before production could again begin. Such a shut-down of packaging machinery and idle manpower represents higher production costs and lower profits to a packager and potential higher prices to a consumer.

It has also been difficult to determine just exactly how little or how much time should be allotted to de-gas a particular product. For example, if coffee is over de-gassed in atmosphere, it is also appreciably oxidized and the quality thereof is thereby impaired, often resulting in an undesirable rancidity reaction in which the coffee becomes unfit for consumption. However, if the coffee is not sufficiently de-gassed and is subsequently packaged in containers, the continued evolution of gases in such containers causes a pressure build-up which is sufficient to subsequently bulge the ends of metal containers or to burst bag-type containers.

Conventional coffee processing installations for vacuum packaging coffee also involve a substantial initial capital expenditure for machinery and smaller coffee packagers find it difficult to compete with their larger (industrialized) competitors.

In accordance with this invention, it is one object to overcome or minimize some of the above-noted and other disadvantages of conventional packaging methods by packaging freshly roasted ground coffee directly into packages without bulk packaging and permitting the coffee to de-gas either in atmosphere or an oxygen-free atmosphere and in each case preventing oxidation of the coffee. This is accomplished by packaging the coffee in containers which are subsequently provided with a one-way valve such as that effected by tortuous passage which is maintained open by gases evolving from the coffee but which closes under the influence of atmosphere when the de-gassing has been completed. In this manner complete de-gassing is achieved and past concern of over or under de-gassing is avoided.

In addition to packaging freshly ground coffee in containers of the type just described, the packages or containers may also be stored after packaging, if desired, in an inert atmosphere for a period of from 6 to 48 hours and are thereafter evacuated and sealed by closing the tortuous passages, when such passages are used, to prevent the subsequent re-entry of atmosphere therein. This procedure makes it doubly certain that the coffee will not be oxidized during the processing thereof and will maintain its freshness and flavor through storage and purchase by a consumer.

An alternative process for eliminating some of the disadvantages of conventional packaging methods and permitting coffee to de-gas properly comprises the procedure of packaging the coffee in containers constructed to facilitate the evolution of gases, such as containers of porous material as are ordinarily used in the manufacture of tea bags, storing the containers in an oxygen-free or inert atmosphere for a predetermined period of time of from 2 to 48 hours, though preferably from 6 to 48 hours, during evolution of the gases and subsequently sealing the containers against atmosphere prior to or immediately after removal of the containers from the oxygen-free atmosphere.

Accordingly, it is a primary object of this invention to provide a novel process for packaging coffee and like products, wherein such products are packaged in containers immediately following a grinding operation, the containers being then stored for a predetermined length of time such that substantially all of the gases evolving from the packaged products and the containers then being sealed against atmosphere.

It is another object of the invention to provide a novel process for packaging coffee and like products, wherein such products are packaged into partially sealed containers immediately following a grinding operation, the partially sealed containers being then stored for a predetermined time to allow the product gases to evolve from the containers and the containers then being completely sealed.

It is a further object of this invention to provide a novel process for packaging gas-evolving products, such as coffee and the like, by filling pouches with the gas-evolving product immediately following a product grinding operation, partially sealing the pouches and then storing the pouches for a predetermined period of time to permit the gases to evolve from the pouches; thereafter, subjecting the pouches to a vacuum to withdraw any remaining air and gases from the pouches and then sealing the pouches to prevent further gaseous passage to and from the product.

It is still further an object of this invention to provide a novel process for packaging coffee and like products by filling pouches, heat-sealing across an open top of the pouches leaving tortuous passages at the top of the pouches for the escape of gases from the gas-evolving products, and storing the pouches for a predetermined time to permit complete de-gassing of the products prior to completely sealing the tortuous passages on respective package or pouch tops.

It is yet another object of this invention to provide a novel method for packaging coffee and like products by forming pouches, filling the pouches with gas-evolving products as part of a continuous operation, partially sealing portions of the pouches to permit gases evolving from a gas-evolving product to pass through unsealed portions thereof, then storing the pouches for a predetermined time to permit de-gassing of the products prior to sealing closed the partially sealed portions.

It is another object of this invention to provide a novel process for packaging coffee or like gas-evolving products, by filling pouches constructed of porous material with the gas-evolving product immediately following a product grinding operation, storing the pouches for a predetermined period of time to permit the gases to evolve from the pouches and enclosing the pouches in air-tight containers, thereby sealing the pouches against further gaseous passage to and from the product.

It is a further object of this invention to provide a novel process for packaging gas-evolving products, such as coffee and the like, by filling porous pouches with the gas-evolving product, storing the pouches for a predetermined period of time to permit the gases to evolve from the pouches, placing the pouches in pockets of gas-impermeable material and covering the pockets with a gas-impermeable web to seal the pouches within pockets in air-tight relation.

It is yet aother object of this invention to provide a novel method for packaging coffee and like products by forming pouches, filling the pouches with gas-evolving products as part of a continuous operation, storing the pouches for a predetermined time to permit de-gassing of the products, and enclosing the pouches in gas-impermeable pockets each having a gas-impermeable web of material sealed thereon in air-tight relation while vacuumizing the pouches within the pockets as part of a continuous operation.

With the above and other objects in view that will hereinafter appear, the nature of the invention will be more clearly understood by reference to the following description, the appended claims, and the several views illustrated in the accompanying drawings.

IN THE DRAWINGS

Figure 1:
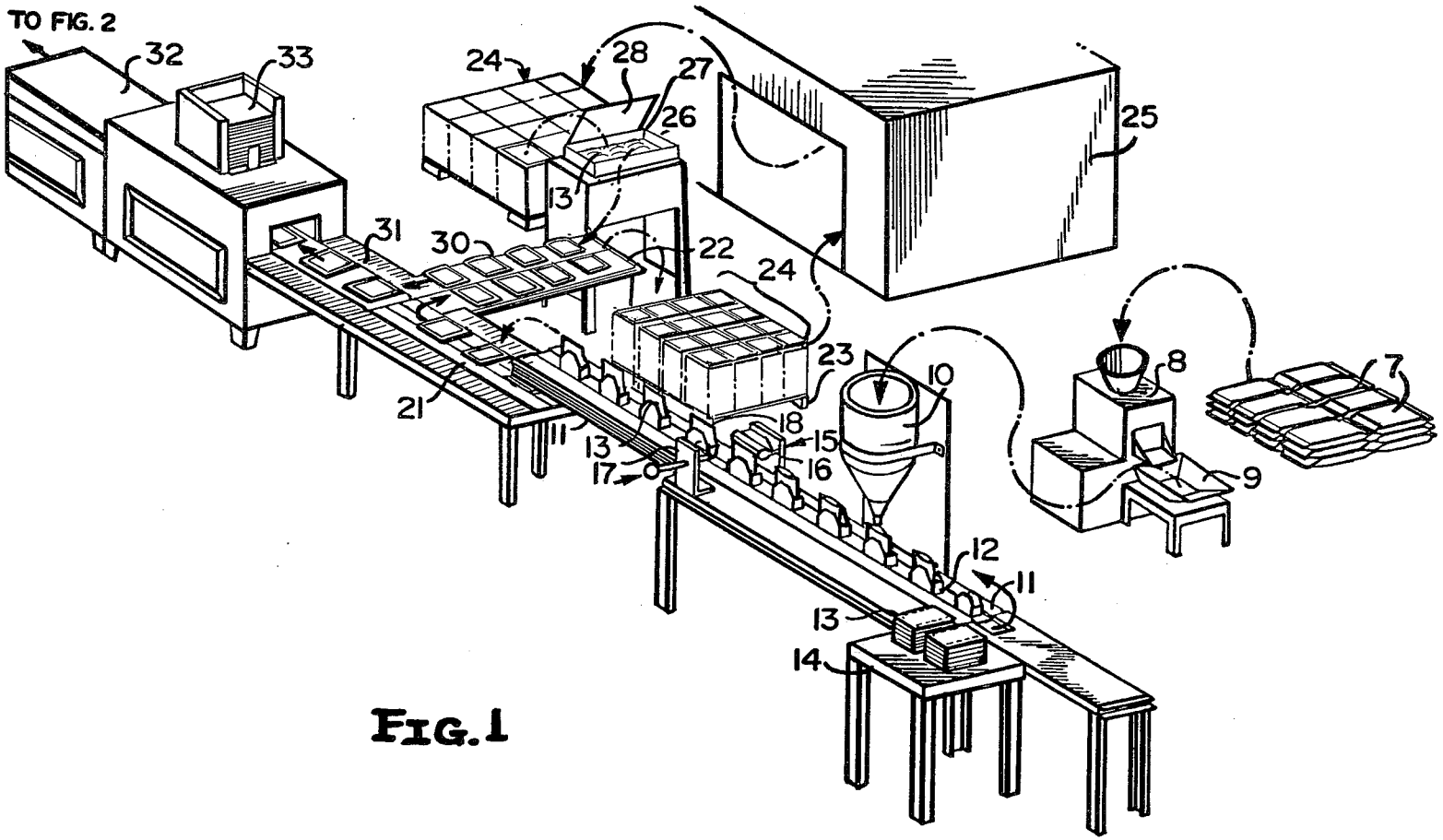
FIG. 1 is a top perspective view of an apparatus with portions thereof in phantom outline, and illustrates means for grinding, filling, partially sealing, storing, vacuum-sealing and wrapping the pouches during the practice of the method of this invention.

Referring now to the drawings in detail, reference is first made to FIG. 1 wherein there is illustrated a plurality of sacks 7 of freshly roasted coffee beans or the like. The coffed beans and the sacks are emptied into a grinder 8, which grinds the beans in a conventional manner to form ground coffee which is deposited into a container 9. The ground coffee is then deposited into a vertical dispensing hopper 10. The dispensing hopper 10 is mounted above a suitable conveying mechanism 11, which has a plurality of moving bag or pouch holders 12. A plurality of bags or pouches 13, of preferably gas-impermeable heat-sealable material, having closed sides and bottoms and open tops, are positioned on a table 14 at one side of the conveyor mechanism 11, and are adapted to be inserted individually into the pouch holders 12 by any suitable means.

The pouches 13 pass beneath the dispensing hopper 10 in the pouch holders 12 and are automatically filled and then passed to a sealing station 15, where the tops of the pouches 13 are partially sealed.

Figures 2, 3, 4:
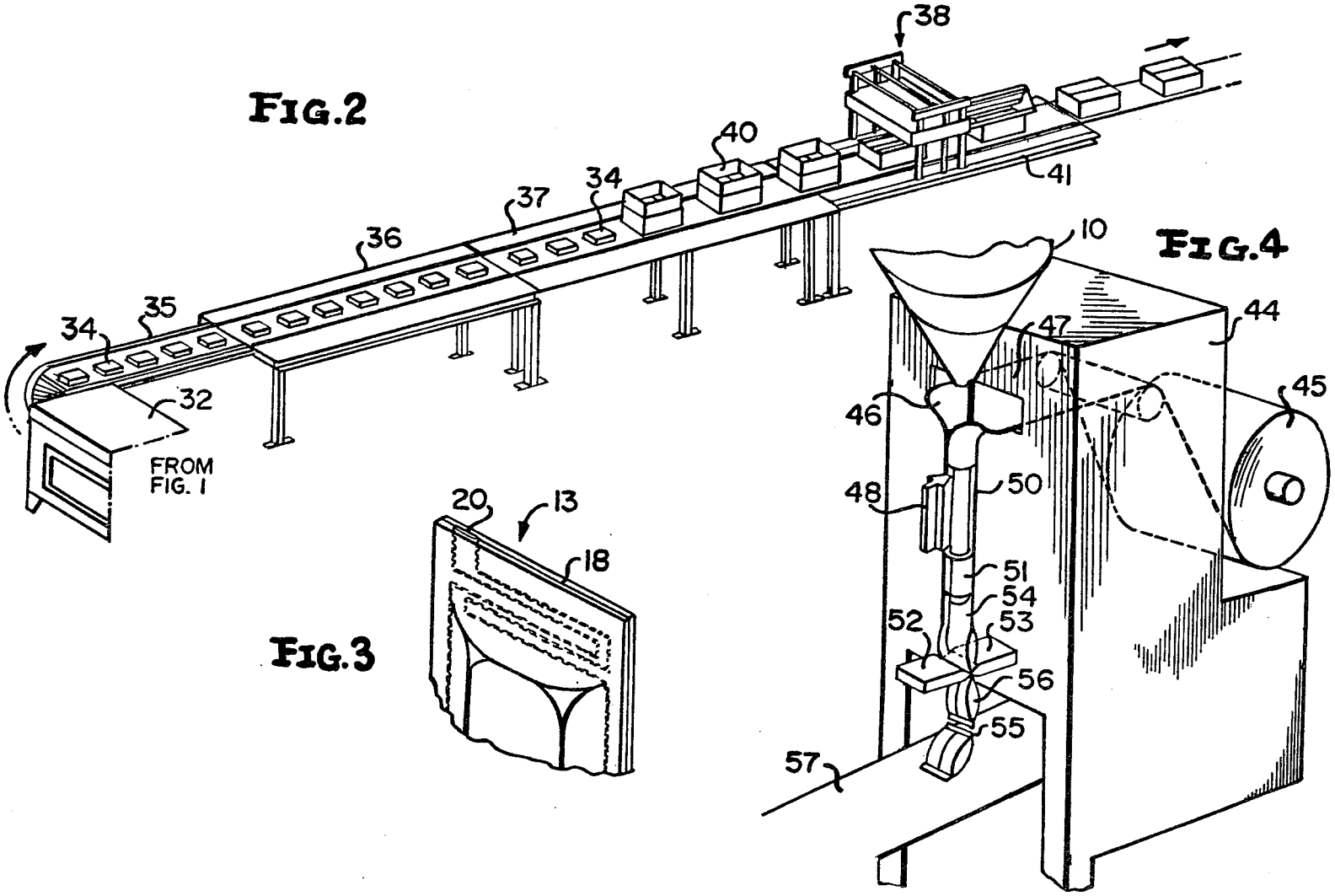
FIG. 2 is a top perspective view of the apparatus with portions thereof being shown in phantom outline, and illustrates further packaging mechanisms whereby a plurality of wrapped pouches are packaged in single cartons.
FIG. 3 is a fragmentary perspective view of a filled and partially sealed pouch constructed particularly for use in the practice of this invention, and illustrates a seal forming a tortuous passage of the pouch.
FIG. 4 is a fragmentary perspective view of alternative apparatus for accomplishing the novel process of this invention, and illustrates an alternative mechanism for performing the bag-forming, filling, separating and partial sealing operations.

The sealing station 15 comprises suitable heat-sealing elements 16 and 17, for forming a heat-seal 18 in the top of each of the pouches 13, with a tortuous unsealed passage 20 at the top of each pouch 13. The partial heat-seal 18 of each pouch 13, as shown in FIG. 3, is placed on an upper margin of each pouch 13 leaving the tortuous unsealed passage 20, in order to permit each of the pouches 13 to emit gases such as carbon dioxide, which evolves from granular solid particles such as coffee, after being subjected to a grinding operation. The particular configuration of each tortuous passage 20 permits the passage of gases outwardly of an associated pouch 13, but prevents oxygen and other atmospheric gases from entering the pouch 13. Each tortuous passage is, in effect, a one-way valve; thus, similar valves may also be used as partial seals.

The partially sealed pouches 13 are then transported further by the conveyor mechanism 11 and are transferred to other suitable conveying means 21, 22 for movement to an area where they may be stacked or grouped upon a pallet 23. A palletized grouping 24 of the partially sealed pouches 13 is then transferred to a storage area 25 (shown in phantom outline) where the pouches are detained for a predetermined period of time for de-gassing.

In the storage area 25, the palletized group 24 of pouches 13 remains for the predetermined period of time, generally from 6 to 48 hours, while virtually all of the carbon dioxide and other gases have been evolved from the product.

When one-way valves are not present on the pouches, the storage area may have a preferably inert atmosphere, such as nitrogen, carbon dioxide or the like, to prevent undesirable gases such as oxygen from entering the pouches and contaminating the coffee. The pouches 13 are then ready to be vacuumized and heat-sealed, in order to prevent seepage of atmospheric gases into the pouches 13.

Thus, when the predetermined period of time has passed, the palletized stack 24 of pouches 13 is then transferred to a position adjacent a vacuum sealer 26. The pouches 13 are then sequentially placed into a tray portion 27 of the vacuum sealer 26, and upon closing of a lid 28, a vacuum is drawn closing the walls of any particular pouch 13 tightly against the products within that pouch, and the tortuous unsealed passage 20 of the partial heat-seal 18 is completely sealed from atmosphere.

The vacuum sealer 26 may be of any suitable type, but commonly comprises a tray 27 having a hinged lid 28 which upon closure with a pouch 13 therein, actuates a vacuum pump (not shown) which draws any gases from inwardly of the tray, including any remaining evolved gases from the product within the pouch 13. Just prior to removal of a pouch from the tray 27, a heat-sealer (not shown) in adjacent relation to the tortuous passage 20 of each pouch 13 heat-seals the passage closed, by confining the package 13 between opposing heating elements, similar to those 16, 17 of FIG. 1.

The pouches 13 are then transferred from the vacuum sealer 26 to a suitable series of conveying tables 30, 31, then through a carton machine 32, where the pouches 13 are packaged in cartons 33 to form packages 34. The packages 34 are then transferred by a suitable series of conveyors 35, 36 and 37 past an inspection station (not shown) to a further packaging station 38 where a plurality of individual cartons 34 are packed into large cartons 40 which are then sealed and transferred by a conveyor 41 to a suitable storage or shipment area.

FIG. 4 illustrates a form-and-fill apparatus whereby an alternative method may be used to simultaneously form pouches to be enclosed along three sides thereof by folding and sealing a web to form pouches, filling the pouches, and partially sealing and severing adjacent pouches. Thus, FIG. 4 shows an apparatus 44 including a roll of film 45 and a guide 46, which continually guides a web 47 to a generally tubular configuration, where a heat-seal seam roller 48 forms a seamed tube 50 positioned immediately below the dispensing hopper 10. A tubular mandrel 51 is positioned below the dispensing hopper 10 and within the sleeve 50, in a manner facilitating the dispensing of coffee particles from the hopper 10 into the sleeve 50, in controlled incremental distribution. Prior to the dispensing of an incremental quantity of ground coffee, cooperating combination cutting and sealing elements 52, 53 effect a transverse seal across the sleeve 50, thus creating an open mouth pouch 54 while simultaneously forming a partial seal 55 having a tortuous pass therein (not shown) in a prior formed adjacent pouch 56, while also simultaneously separating the pouches 54, 56 between adjacent heat-sealed portions thereof, yielding separated, filled, partially sealed pouches 56. The pouches 56 are then transferred by any suitable conveyor means 57 to a storage area for degassing for a predetermined period of time as has been heretofore described.

Figure 5:
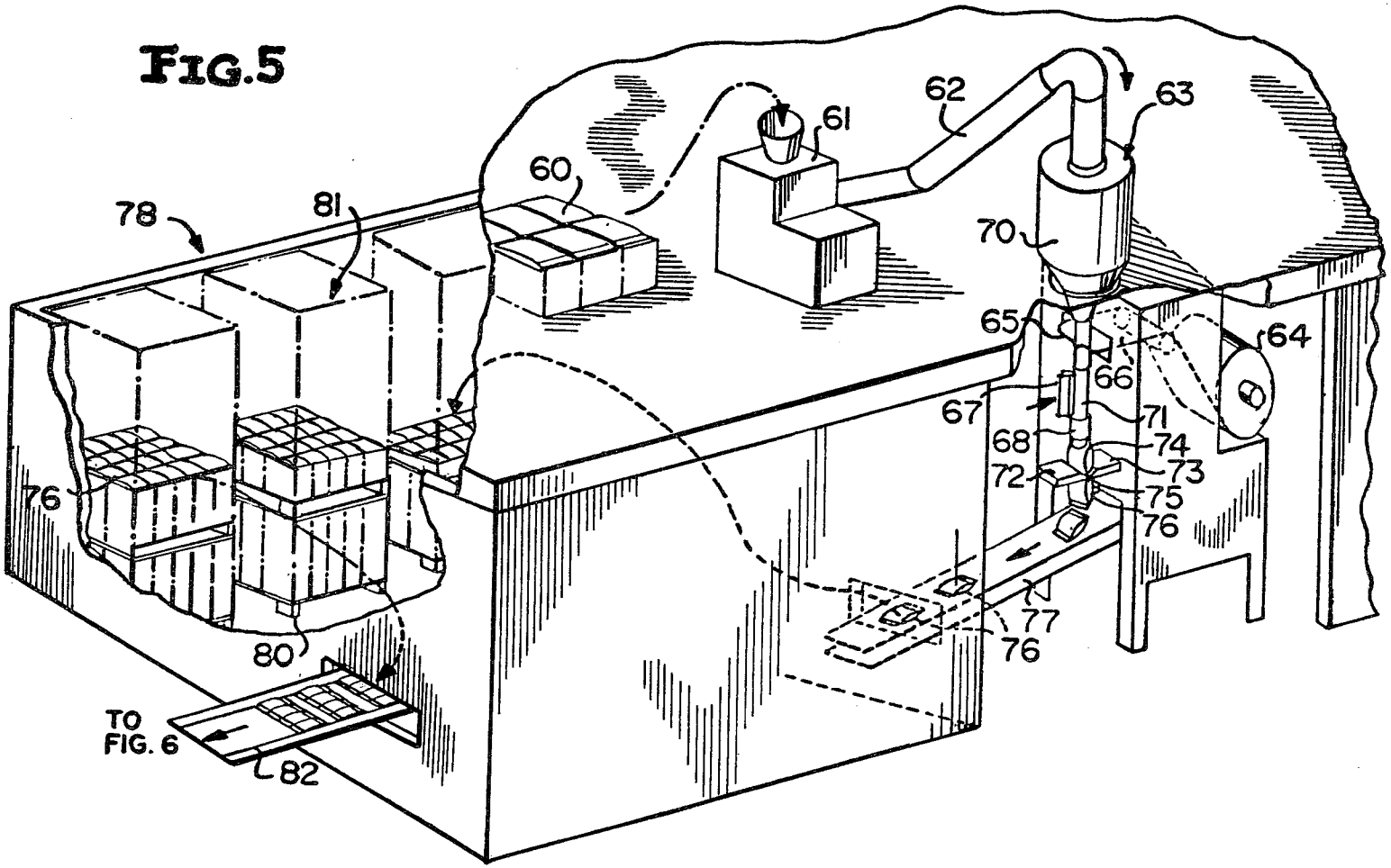
FIG. 5 is a top perspective view of an apparatus with portions thereof shown in phantom outline, and illustrates means for grinding, forming and filling product pouches, and storing the pouches for a period of time during the practice of an alternative method of this invention.
Figure 6:
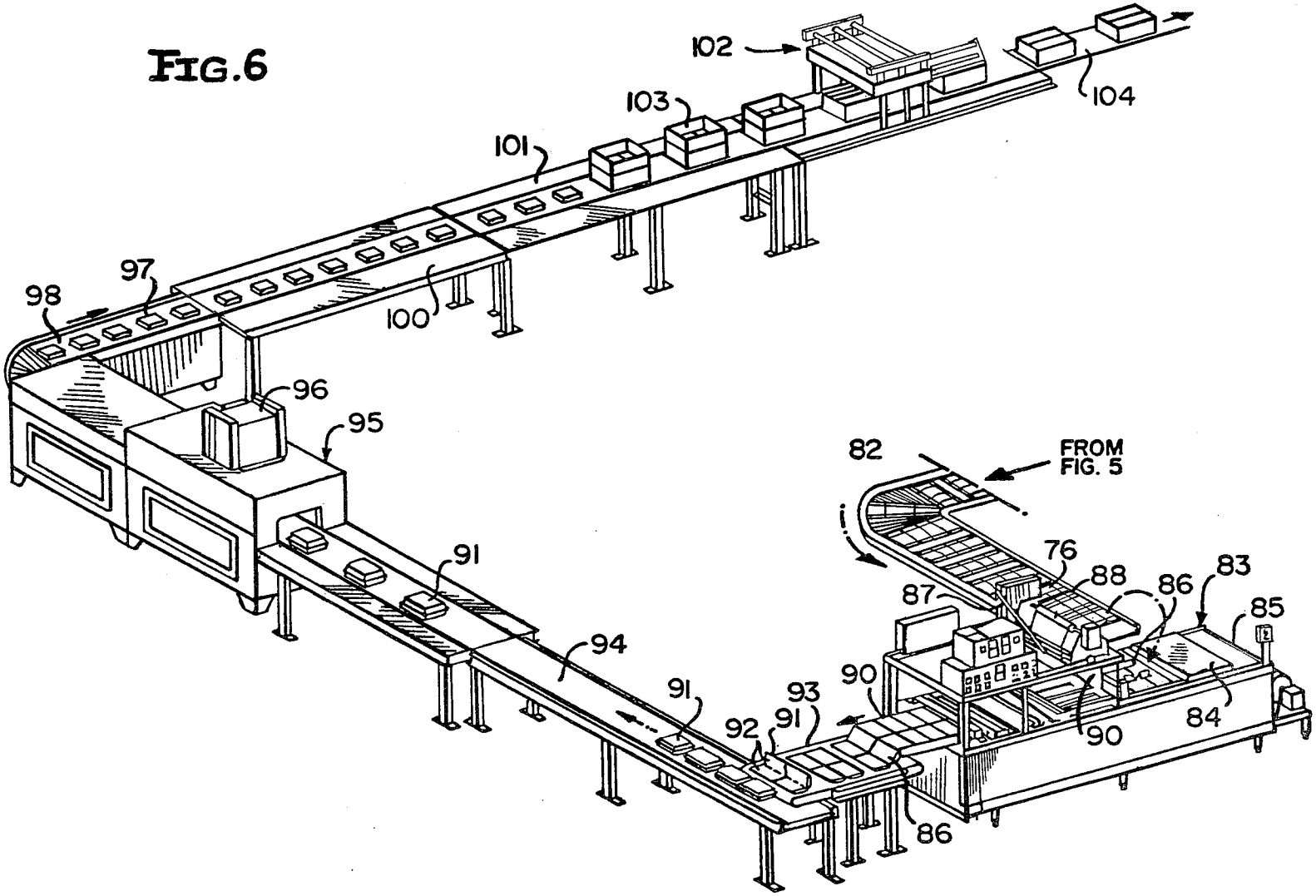
FIG. 6 is a top perspective view of an apparatus adapted to complete the packaging of an air-tight pouch according to the process performed by the apparatus of FIG. 5, and illustrates means for enclosing and vacuumizing pouches in covered gas-impermeable pockets and for subsequently packaging the enclosed pouches in cartons.

Referring to FIG. 5 of the drawings, there is illstrated an apparatus for accomplishing an alternative process of this invention, utilizing a relatively porous pouch material. A plurality of sacks 60 of freshly roasted coffee beans or the like are emptied into a grinder 61 which grinds the beans to form ground coffee. The ground coffee is then transferred via a conduit 62 into a form-and-fill apparatus, generally designated by the numeral 63, similar to the apparatus of FIG. 4.

The form-and-fill apparatus 63 includes a roll of film 64 and a film guide 65, which continually guides a web 66 to a generally tubular configuration, where a heat-seal seam roller 67 forms a seamed tube 68 positioned below the dispensing hopper 70. A tubular mandrel 71 is positioned below the dispensing hopper 70 and within the sleeve 68, to incrementally dispense coffee particles from the hopper 70 into the sleeve 68. Prior to the dispensing of an incremental quantity of ground coffee, cooperating combination cutting and sealing elements 72, 73 effect a transverse seal across the sleeve 68, thus creating an open mouth pouch 74 while simultaneously forming a seal 75 in a prior-formed adjacent pouch 76, while also simultaneously separating the pouches 74, 76 between adjacent heat-sealed portions thereof, yielding separated, filled pouches 76, having the ends thereof sealed closed. The pouches 76 are then transferred by any suitable conveyor means 77 into a storage area (generally designated by the numeral 78).

In the storage area 78, the pouches 76 are transferred by suitable conveying means onto pallets 80, in palletized groupings 81, where the pouches are detained for a predetermined period of time for de-gassing. A plurality of palletized groupings 81 of pouches 76 remain in the storage area 78 for the predetermined period of time, of from 2 to 48 hours, though preferably from 6 to ?hours, in an atmosphere of oxygen-free or inert gas, while virtually all of the carbon dioxide and other gases have been evolved from the products. The inert atmosphere of the storage area 78 allows product de-gassing, while preventing undesirable gases such as oxygen from entering the passage and contaminating the coffee. The pouches 76 are then ready to be enclosed in air-tight containers, in order to prevent seepage of atmospheric gases back into the pouches 76 during later shipment.

When the predetermined period of time has passed for storage of the pouches in the storage area 78, the pouches are placed on conveyor 82 to an enclosing apparatus (generally designated by the numeral 83).

The enclosing apparatus 83 includes a web heating means 84 and a vacuum drawing means (not shown) for forming pockets 86, four at a time, in a web 85 of gas-impermeable material, as part of a continuous operation. The pouches 76 are then deposited in the pockets 86, and are transferred beneath a covering apparatus 87 where another web of gas-impermeable material 88 is positioned to continuously deposit a web 90 of the material into overlying relation with the pockets 86, thereby completely enclosing the pouches 76 therebetween. The web 90, forming the covering layer of gas-impermeable material, is then heat-sealed around all adjacent upstanding pocket edges, to completely define four separately enclosed pockets. Simultaneously therewith, the enclosed pockets are vacuumized whereby atmospheric gases and any remaining evolved gases from the products within the pouch are withdrawn from the pockets, by means of a vacuum pump (not shown) component of the enclosing apparatus 83, which pump may be the same vacuum drawing means which provides suction for drawing the pockets 86. The enclosed pockets are then suitably separated, as by slitting wheels or blades (not shown) and suitably positioned to separate the pockets longitudinally and transversely into two foldably joined double packages 91, each half of each double package comprising a pocket having a seal overlapped thereon, and enclosing a degassed pouch 76 therein.

One package 92 of each double package 91 is folded into overlying relation to the other package 92 of the double package 91, and the double packages 91 are then transferred along suitable conveyors 93, 94 to a carton machine 95.

In the carton machine 95, the double packages 91 are packaged in cartons 96 to form wrapped packages 97. The wrapped packages 97 are then transferred by a suitable series of conveyors 98, 100, 101 past an inspection station (not shown) to a further packaging station 102 where a plurality of individual wrapped packages 97 are packed into large cartons 103 which are then sealed and transferred by a conveyor 104 to a suitable storage or shipment area.

Although only preferred embodiments of the invention have been described and illustrated herein, it is to be understood that minor modifications can be made in the process and in its application within the spirit and scope of the invention, as defined in the appended claims.

I claim:

1. A process of packaging a solid gas-evolving product comprising the steps of providing a plurality of pouches, filling the pouches with said gas-evolving product, transferring the filled pouches to a storage chamber containing oxygen at atmospheric conditions of temperature and pressure, storing the filled pouches in the storage chamber for a predetermined length of time at such conditions and within said oxygen containing atmosphere such that the product is in fluid communication with the surrounding medium until substantially all of the gas capable of evolving from the product has evacuated the pouches, removing the pouches from the storage chamber, thereafter completely hermetically sealing the pouches against oxygen containing atmosphere, said pouch filling step is immediately followed by a partial sealing step for partially sealing each pouch mouth by forming a heat-seal in each pouch mouth while leaving a relatively small tortuous passage for the escape of gas from said gas-evolving product, and each tortuous passage is completely sealed during the performance of said hermetically sealing step.

2. The process as defined in claim 1 including the step of forming said plurality of pouches from gas impermeable material.

3. The process as defined in claim 2 including the step of forming the plurality of pouches from a continuously provided web of said gas impermeable material, and said partial sealing step is performed simultaneously with a cutting step upon the same portion of the web thereby individually separating the pouches.

4. The process as defined in claim 2 including the step of vacuumizing the pouch interiors prior to the performance of said hermetically sealing step.

5. A process for packaging a solid gas-evolving product comprising the steps of providing a plurality of pouches, filling the pouches with said gas-evolving product, transferring the filled pouches to a storage chamber containing an inert gaseous oxygen free atmosphere at atmospheric conditions of temperature and pressure, storing the filled pouches in the storage chamber for a predetermined length of time at such conditions and within said inert gaseous oxygen free atmosphere such that the product is in fluid communication with the surrounding medium until substantially all of the gas capable of evolving from the product has evacuated the pouches, removing the pouches from the storage chamber, thereafter completely hermetically sealing the pouches against oxygen containing atmosphere, said pouch filling step is immediately followed by a partial sealing step for partially sealing each pouch mouth by forming a heat-seal in each mouth while leaving a relatively small tortuous passage for the escape of gas from said gas-evolving product, and each tortuous passage is completely sealed during the performance of said hermetically sealing step.

* * * * *